United States Patent [19]

Hudson et al.

[11] Patent Number: 4,618,412

[45] Date of Patent: Oct. 21, 1986

[54] HYDROCRACKING PROCESS

[75] Inventors: Carl W. Hudson; Glen P. Hamner, both of Baton Rouge, La.

[73] Assignee: Exxon Research and Engineering Co., Florham Park, N.J.

[21] Appl. No.: 760,835

[22] Filed: Jul. 31, 1985

[51] Int. Cl.[4] ..... C10G 65/10; C10G 65/18

[52] U.S. Cl. ..... 208/59; 208/112

[58] Field of Search ..... 208/59, 100, 102, 112

[56] References Cited

U.S. PATENT DOCUMENTS

| | | | |
|---|---|---|---|
| 2,057,971 | 10/1936 | Pfirrmann | 208/112 |
| 3,501,395 | 3/1970 | Miale | 208/112 |
| 3,816,298 | 6/1974 | Aldridge | 208/112 |
| 4,067,799 | 1/1978 | Bearden, Jr. et al. | 208/112 |
| 4,411,768 | 10/1983 | Unger et al. | 208/59 |
| 4,421,635 | 12/1983 | Murakami et al. | 208/112 |
| 4,447,315 | 5/1984 | Lamb et al. | 208/99 |

FOREIGN PATENT DOCUMENTS

| | | | |
|---|---|---|---|
| 0161493 | 5/1980 | Japan | 208/112 |
| 0177346 | 4/1981 | Japan | 208/112 |
| 0364043 | 12/1931 | United Kingdom | 208/112 |

*Primary Examiner*—Andrew H. Metz
*Assistant Examiner*—O. Chaudhuri
*Attorney, Agent, or Firm*—Llewellyn A. Proctor

[57] ABSTRACT

A process for hydrocracking a hydrocarbon feedstock having a propensity to form polynuclear aromatic hydrocarbon compounds to suppress fouling the processing unit. The hydrocracking method includes contacting the hydrocarbon feedstock with a crystalline zeolite hydrocracking catalyst, contacting at least a portion of the resulting unconverted hydrocarbon oil containing polynuclear aromatic compounds with an iron catalyst in the presence of hydrogen to hydrogenate and hydrocrack the polynuclear aromatic hydrocarbon compounds, and recycling unconverted hydrocarbon oil having a reduced concentration of polynuclear aromatic compounds to the hydrocracking zone.

24 Claims, 4 Drawing Figures

HYDROCRACKING PROCESS

BACKGROUND OF THE INVENTION AND PRIOR ART

I. Field of the Invention

The invention relates to improvements in the catalytic hydrocracking of hydrocarbonaceous feedstocks to produce lower boiling hydrocarbon products. In particular, it relates to an improved process for suppressing the normal tendency in hydrocracking hydrocarbon feedstocks, which have a propensity to form polynuclear aromatic hydrocarbon compounds (PNA's) during hydrocracking, to form compounds which foul the hydrocracking unit.

II. Backgrounds and Problems

In a typical hydrocracking process a heavy product stream which contains unconverted feed molecules and the PNA's formed during the process, is recycled back to the conversion reactors through a heat exchanger zone. In this zone the recycle stream is cooled which can lead to precipitation of a portion of the relatively insoluble PNA's. The precipitated PNA's have a tendency to form a crust on the interior surface of the heat exchangers thereby reducing heat transfer capabilities, this limiting throughput and interfering with the performance of the unit. Ultimately, this can lead to plugging of the unit and forced shutdown. Removal of the PNA's in the recycle stream can improve process flexibility, increase unit cycle length, and probably improve product quality. This problem is recognized, and addressed in, e.g., U.S. Pat. No. 4,447,315. Other solutions to the problem are nonetheless needed.

SUMMARY OF THE INVENTION

A catalytic hydrocracking process which comprises: (1) contacting a hydrocarbon feedstock having a propensity to form polynuclear aromatic hydrocarbon compounds in a hydrocracking zone, with added hydrogen, over a promoted crystalline zeolite hydrocracking catalyst at elevated temperature and pressure sufficient to give a substantial conversion of the feedstock to vaporous lower boiling products; (b) condensing the hydrocarbon effluent from the hydrocracking zone to provide a liquid hydrocarbon product and unconverted hydrocarbon oil containing small quantities of polynuclear aromatic compounds; (c) contacting at least a portion of the unconverted hydrocarbon oil containing polynuclear aromatic hydrocarbon compounds, in the presence, of hydrogen, over a catalyst which contains elemental iron and one or more of an alkali or alkaline-earth metal [i.e., a Group IA or IIA metal (Periodic Table of the Elements, E. H. Sargent & Co., Copyright 1964 Dyna-Slide Co.)] or compound thereof, and preferably additionally a Group IIIA metal, or metal compound, particularly aluminum, or compound thereof, at temperature sufficient to hydrogenate and hydrocrack the polynuclear aromatic hydrocarbon compounds, and (d) recycling unconverted hydrocarbon oil having a reduced concentration of polynuclear aromatic compounds resulting from step (c) to the hydrocracking zone.

A key and novel feature of the process of this invention resides in the discovery that the polynuclear aromatic hydrocarbons, particularly those which contain four or more aromatic rings in a molecule, notably the coronenes and benzocoronenes, which are of very limited solubility in the condensed, liquid hydrocarbon effluent from the hydrocracking zone of (b), can be hydrogenated and hydrocracked over the iron catalyst as described in (c) and in effect removed or eliminated from the recycle stream to eliminate gum formation and fouling of the hydrocracking unit as normally occurs when such polynuclear are recycled to the hydrocracking zone and plated out, precipitated, condensed and cracked upon solid surfaces interfacing with said hydrocracking zone.

BRIEF DESCRIPTION OF THE DRAWINGS

The attached drawing, FIG. 1, schematically illustrates an embodiment of the present invention, including a generally conventional hydrocracking unit and an added vessel for PNA removal from the recycle stream of the hydrocracking process unit.

DETAILED DESCRIPTION OF THE INVENTION

Figure 1:
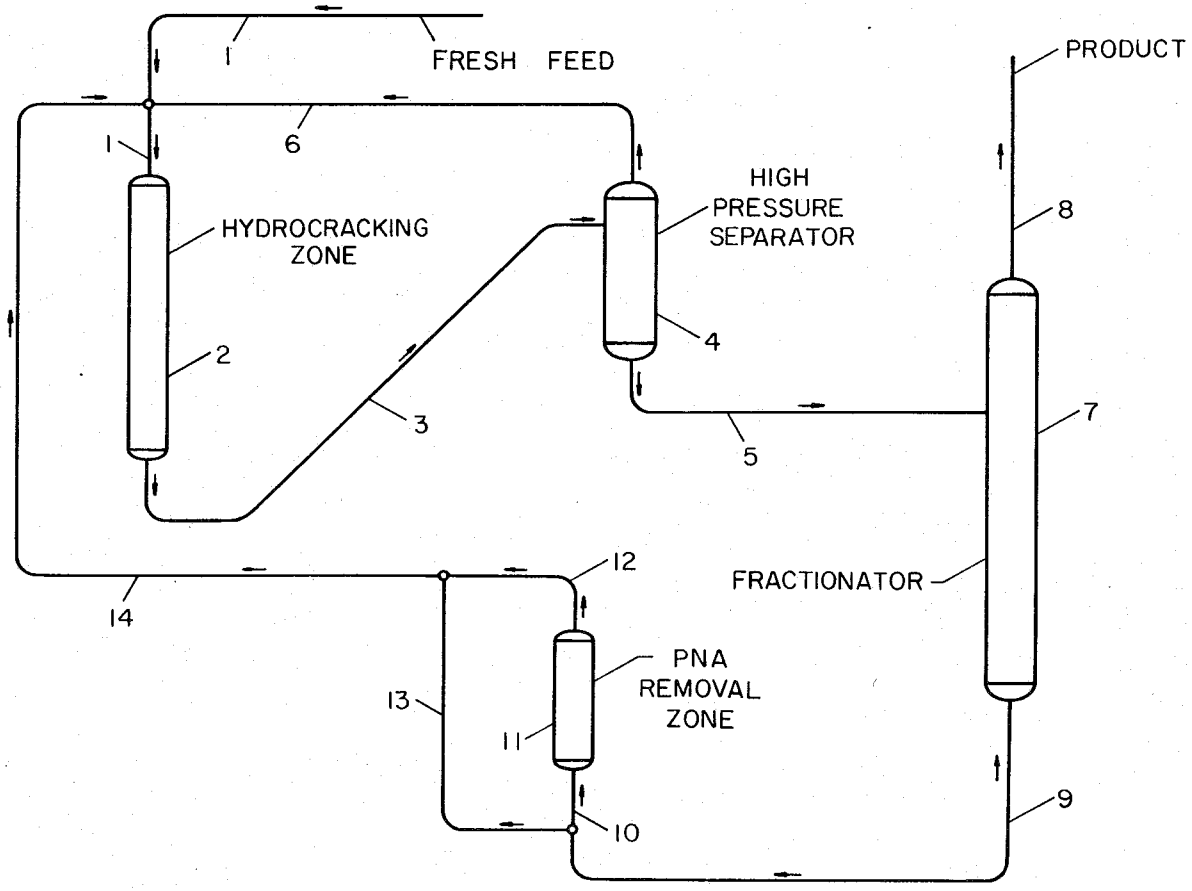

In accordance with this invention, a total recycle of unconverted oil can be maintained indefinitely to the above-described hydrocracking process units without encountering the above discussed fouling problems.

All or a portion of the unconverted hydrocarbon oil or recycle stream containing PNA's or precursors thereof is contacted with the iron catalyst at conditions which selectively hydrogenate and hydrocrack, and thereby reduce the molecular weight of the polynuclear aromatic hydrocarbon compounds, the transformation and removal of the PNA's from the recycle hydrocarbon stream in this manner thereby drastically minimizing the concentration of material which produces fouling of the unit, and auxillary equipment.

Essentially any hydrocarbon oil feedstock which contains PNA's or their precursors in an amount sufficient to result in a buildup thereof to levels above their solubility limit in the process streams can be employed in the hydrocracking process of the present invention. Exemplary of such hydrocarbon feedstocks are, for example, gas oil, vacuum gas oil, catalytic cycle oil, and mixtures thereof. The most serious fouling problems are encountered when crystalline zeolite catalysts, as described hereinafter, are employed as hydrocracking catalysts. In some cases, foulant concentrations as low as one weight part per million (wppm) may be sufficient to result in such undesirable buildup, although generally amounts greater than about 5 wppm are required to possess such propensity. The troublesome PNA's are defined as any PNA's of two or more fused rings. Such aromatic molecules include naphthalenes and indenes (2-rings), anthracenes, phenanthrenes, fluorenes, and acenaphthenes (3-rings), benzanthracenes, benzphenanthrenes, perylenes, tetracenes, and pyrenes (4-rings), benzopyrenes, benzoperylenes, pentacenes, and dibenzanthracenes (5-rings), coronenes (6-rings), benzcoronenes (7-rings) and others of this general type. Also included in this group are partially hydrogenated derivatives of the above molecules in which one or more of the aromatic rings has been hydrogenated. In particular, the PNA's referred to herein are those which contain four or more aromatic rings, especially the coronenes and benzocoronenes, which display very limited solubility in hydrocarbon mixtures.

Preferred catalysts for use in the present invention comprise in general any crystalline zeolite cracking base upon which a minor proportion of a Group VIII metal hydrogenating component is deposited. Additional hydrogenating components may be selected from Group VIB for incorporation with the zeolite base. The zeolite cracking bases are sometimes referred to in the art as molecular sieves, and are usually composed of silica, alumina and one or more exchangeable cations such as sodium, hydrogen, magnesium, calcium, rare earth metals, etc. They are further characterized by crystal pores of relatively uniform diameter between about 4 and 14, angstrom units, Å. It is preferred to employ zeolites having a relatively high silica/alumina mole ratio between about 3 and 12, and even more preferably between about 4 and 8. The natural occurring zeolitesare normally found in a sodium form, an alkaline earth metal form, or mixed forms. Suitable zeolites found in nature include for example mordenite, stilbite, heulandite, ferrierite, dachiardite, chabazite, erionite, and faujasite. Suitable synthetic zeolites include for example the B, X, Y, and L crystal types or synthetic forms of the natural zeolites noted above, e.g., synthetic faujasite and mordenite. The preferred zeolites are those having crystal pore diameters between about 8–12 Å, wherein the silica/alumina mole ratio is about 4 to 6. A prime example of a zeolite falling in this preferred group is synthetic Y molecular sieve.

The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been "decationized." Y zeolites of this nature are more particularly described in U.S. Pat. No. 3,130,006.

Mixed polyvalent metal-hydrogen zeolites may be prepared by ion-exchanging first with an ammonium salt, then partiallY backexchanging with a polyvalent metal salt and tnen calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion-exchange capacity is satisfied by hydrogen ions.

The active metals employed in the hydrocracking catalysts as hydrogenation components are those of Group VIII, i.e., iron, cobalt, nickel, ruthenium, rhodium, palladium, osmium, iridium, and platinum. In addition to these metals, other promoters may also be employed in conjunction therewith, including the metals of Group VIB, e.g., molybdenum and tungsten. The amount of hydrogenating metal in the catalyst can vary within wide ranges. Generally, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., from about 370° C. to about 650° C. (700°–1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal, e.g., a Group VIB and/or Group VIII metal.

In accordance with the present invention, a portion of the unconverted hydrocarbon oil containing polynuclear aromatic compounds, or PNA's, is contacted with the iron catalyst at temperature ranging from about 225° C. (437° F.) to about 430° C. (806° F.), more preferably from about 250° C. (482° F.) to about 350° C. (662° F.), and at hydrogen partial pressures ranging from about 0 psig to about 1000 psig, preferably from about 100 psig to about 600 psig, sufficient to hydrogenate and hydrocrack the PNA's of the admixture of hydrocarbons. Some positive pressure of hydrogen is necessary in conducting the reaction, though the hydrogen pressure can thus be at atmospheric pressure, or less. Temperatures above about 430° C. (806° F.) generally should not be employed because excessive temperature causes cracking of the feed, and carbon fouling of the catalyst. At temperatures below about 225° C. (437° F.), on the other hand, the reaction rate is generally to slow to be of practical interest. Total pressures are not critical, but generally range from about 0 psig to about 1200 psig, preferably from about 100 psig to about 750 psig. Treat gas rates, based on hydrogen, range from about 500 to about 10,000 SCF/B, preferably from about 1000 to about 5000 SCF/B. Space velocities range generally from about 0.05 LHSV to about 20 LHSV, preferably from about 0.2 LHSV to about 10 LHSV.

The alkali or alkaline-earth metal promoted iron catalyst required for the practice of this invention can be supported or unsupported, but in either instance it is one the catalytic surface of which is constituted essentially of metallic, or elemental iron (Fe°) crystallites about which the alkali or alkaline-earth metals are dispersed, generally as a monolayer of an alkaline oxide or alkaline-earth metal oxide. The catalyst is unsulfided, and can function in the presence of sulfur only when a sufficient portion of the catalytic surface of the catalyst is substantially metallic, or elemental iron (Fe°). The formation of sufficiently high concentrations of sulfur at the catalyst surface tends to produce catalyst deactivation via the formation of iron sulfide upon the catalyst surface as a consequence of which the use of feeds which contain high concentrations of sulfur or sulfur compounds should be avoided. High concentration of feed sulfur will soon deactivate the catalyst by converting a major portion of the metallic, or elemental iron surface of the catalyst to iron sulfide.

Elemental iron, modified with one or more alkali or alkaline-earth metals, or compounds thereof, is present in the catalyst sufficient to produce on contact with a feed at reaction conditions selective hydrogenation followed by carbon-carbon bond cleavage of the PNA compounds of the feed, preferably without significant cracking of the non-PNA hydrocarbon components of the feed. In such reactions some of the PNA's are cracked to produce gas, and some are cracked to lower molecular weight liquid hydrocarbons. The PNA carbon-carbon bond cleavage reaction occurs over catalysts which contain iron, preferably as the major component, or major metal component. The catalyst may be bulk (unsupported) iron, or iron dispersed upon a support. The bulk iron catalyst is preferred and it may be employed as essentially metallic iron in bulk promoted or modified with alkali or alkaline-earth metals, or metal oxides such as sodium, potassium, cesium, magnesium, calcium, barium, or the like. The active iron catalyst, when a bulk iron catalyst, is preferably one which contains at least 50 percent elemental iron, more preferably from about 70 percent to about 98 percent elemental iron, based on the weight of the catalyst. The iron catalyst, when a catalyst wherein the iron is distributed or dispersed upon a support, contains at least about 0.1 percent iron (measured as elemental iron), preferably from about 0.1 percent to about 50 percent iron, and more preferably from about 5 percent to about 25 percent iron, based on the total weight of the catalyst, and the supported metallic component, exclusive of the support component, or components, contains at least 50 percent iron (measured as elemental iron), and preferably from about 70 percent to about 98 percent iron.

A bulk fused iron catalyst is preferred. The fused iron catalyst is prepared by heating and melting the iron, thus fusing the iron with an alkali or alkaline-earth metal, or metals, or with an alkali or alkaline-earth metal compound, or compounds, which are generally present in concentrations ranging from about 0.01 percent to about 10 percent, preferably from about 0.2 percent to about 4 percent, based on the total weight of catalyst. Sodium, potassium, cesium, magnesium, calcium, and barium are the preferred alkali or alkaline-earth metals. Aluminum is also a preferred component of the fused iron, and it can be present as aluminum metal or an aluminum compound, or compounds, especially as an aluminum oxide. The aluminum metal, or compound thereof, is preferably contained in the catalyst in concentration ranging from about 0.01 percent to about 20 percent, preferably from about 0.5 percent to about 5 percent, calculated as aluminum oxide, based on the weight of the catalyst. Other metals may also be used as promoters and/or modifiers which are added to or contained within the catalyst, such metals including rhenium, nickel, cobalt, palladium, platinum, and copper. Such metals may be added to the catalyst alone or admixed one metal with another, or with other metals.

The iron based catalyst, as suggested, may also be supported; preferably upon an inorganic oxide support. Supports include, but are not limited to, the oxides of aluminum, silicon, boron, phosphorous, titanium, zirconium, calcium, magnesium, barium, and mixtures of these and other components. Other supports may include clays, such as bentonite, zeolites, and other alumino-silicate materials, e.g., montmorillionite. Additional supports may be selected from the group of refractory carbides and nitrides of the transition metals of Groups IVB, VB, VIB, VIIB, and Group VIII iron group metals. Alumina is a preferred support. The iron based catalysts are prepared by methods which include precipitation, coprecipitation, impregnation, vapor deposition, and the formation of metal complexes (i.e., metal carbonyl, etc.) and the like. The impregnation of a porous inorganic oxide support, such as alumina, with a solution of an iron salt with subsequent drying, calcination and reduction of the supported iron catalyst by contact and treatment of the catalyst with hydrogen or hydrogen and ammonia, or ammonia in admixture with another reducing gas, or gases, has been found to provide a highly active catalyst. Impregnation of the support with iron, or iron and other metal promoters or modifiers, by the incipient wetness technique, or technique wherein the iron is contained in solution in measured amount and the entire solution absorbed into the support, subsequently dried, calcined, and activated by contact with ammonia, or ammonia in admixture with hydrogen or other reducing gas has been found particularly satisfactory in preparing a supported catalyst. The supported iron catalyst is promoted or modified with alkali or alkaline-earth metals, or oxides of such metals as sodium, potassium, cesium, magnesium, calcium, barium, or the like. The alkali or alkaline-earth metal, or metals, are generally employed in concentrations ranging from about 0.01 percent to about 10 percent, preferably from about 0.2 percent to about 4 percent, based on the total weight of metal, exclusive of the weight of the support. Sodium, potassium, magnesium, and calcium are the preferred alkali or alkaline-earth metals. Aluminum is also a preferred promoter, or modifier, and as with the bulk iron catalyst can be present as aluminum metal or an aluminum compound, or compounds, especially as an aluminum oxide. The aluminum metal, or compound thereof, is preferably employed in the catalyst in concentration ranging from about 0.01 percent to about 20 percent, preferably from about 0.5 percent to about 5 percent, calculated as aluminum oxide ($Al_2O_3$), based on the total weight of the supported component, exclusive of the weight of the support. Rhenium, nickel, cobalt, palladium, platinum, and copper can also be added to the catalyst as promoters or modifiers, these metals generally being added in concentrations ranging from about 0.01 percent to about 10 percent, preferably from about 0.5 percent to about 2.5 percent, based on the weight of the supported component, exclusive of the weight of the support. After impregnation of the support, the metal impregnated support is dried generally at temperatures ranging from about 65° C. to about 280° C., preferably from about 80° C. to about 110° C., in circulating air, vacuum or microwave oven. The calcination is suitably conducted at temperatures ranging from about 300° C. to about 650° C., preferably from about 450° C. to about 550° C.

The iron catalysts can be reduced, activated, or reactivated by contact with hydrogen, by sequential contact with hydrogen and ammonia, or reduced and activated by contact with an admixture of ammonia and hydrogen or by contact with an admixture of ammonia and another reducing gas or gases. The reducing gas and ammonia can be generated in situ or ex situ. The catalysts are more effectively activated if activated by contact with a stream of flowing hydrogen, or by contact with a stream characterized as an admixture of hydrogen and ammonia, or admixture of ammonia and another reducing gas, or gases. In addition, other pretreatment conditions may be used in combination with reduction in order to modify and/or enhance the catalyst. Treatment with a hydrogen rich blend with some carbon containing gas, e.g., carbon monoxide or carbon dioxide, can be used to introduce carbon to the catalyst.

The catalyst is reactivated, after deactivation, by contact with hydrogen, or by contact with ammonia in admixture with hydrogen, or ammonia in admixture with another reducing gas, or gases. Similarly, the activity-maintenance of the catalyst can be maintained during an operating run by introducing ammonia, or ammonia in admixture with another gas, or gases, with the nitrogen-containing feed. In general, the ammonia is employed in admixture with another gas, or gases, in concentration ranging from about 0.01 percent to about 20 percent, preferably from about 0.2 percent to about 10 percent, based on the volume of the gas.

The catalyst is activated, pretreated, or reactivated by contact with the gas, or gaseous admixture, at temperatures ranging from about 300° C. to about 600° C., preferably from about 400° C. to about 500° C. Suitably pressures range from about 0 psig to about 1500 psig, preferably from about 0 psig to about 750 psig. Hydrogen partial pressures generally range from about 0 psig to about 1200 psig, preferably from about 100 psig to about 600 psig. Space velocities generally range from about 100 GHSV to about 10,000 GHSV, preferably from about 1000 GHSV to about 5000 GHSV.

Reference is made to FIG. 1 for a further description of the process. In the drawing, fresh feed hydrocarbon is introduced to hydrocracking zone 2 via conduit 1. A gaseous hydrogen stream is introduced to hydrocracking zone 2 via conduits 1, 6. A recycle hydrocarbon oil having a reduced concentration of PNA's is introduced to hydrocracking zone 2 via conduits 1, 14. The admixture of fresh feed hydrocarbon, recycle hydrocarbon oil and gaseous hydrogen is reacted in hydrocracking zone 2 at conditions sufficient to convert at least a portion of the fresh feed hydrocarbon to lower boiling hydrocarbons. Hydrocracking zone 2 is packed with one or more beds of zeolite hydrocracking catalyst. Suitable hydrocracking conditions for hydrocracking zone 2 can vary within the following ranges:

| | Hydrocracking Conditions | |
|---|---|---|
| | Typical Range | Preferred Range |
| Temperature, °C. (°F.) | 232–455 (450–850) | 260–413 (500–775) |
| Pressure, psig | 500–4000 | 1000–3000 |
| LHSV | 0.2–20 | 0.5–10 |
| Hydrogen Circulation, SCFB | 2000–20,000 | 2000–10,000 |

The effluent from hydrocracking zone 2 is withdrawn via conduit 3 and cooled to condense the normally liquid hydrocarbons via heat exchange means (not shown). The condensed hydrocracking zone efluent is introduced via conduit 3 into high pressure separator 4. A gaseous hydrogen-rich stream is withdrawn from high pressure separator 4 and recycled to hydrocracking zone 2 via conduit 6.

The condensed normally liquid hydrocarbons are removed from high pressure separator 4 via conduit 5 and transferred to fractionator 7. In fractionator 7, the desired hydrocarbon product is separated and recovered via conduit 8. A heavy hydrocarbon fraction having a boiling range greater than the hydrocarbon product and containing PNA's is separated in fractionator 7 and withdrawn via counduit 9 as a recycle stream. The hydrocarbon recycle stream is transferred via conduits 9, 10 to PNA removal zone 11 which contains the iron catalyst. Thus treated, the hydrocarbon recycle stream containing reduced quantities of PNA's is transferred from the PNA removal zone 11 back to hydrocracking zone 2 via conduits 12, 14, 1. Conduit 13 represents a by-pass for the transfer of untreated recycle hydrocarbon stream to hydrocracking zone 2 via conduits 14, 1; which mode can be used when PNA removal zone 11 is being renewed or repaired.

The invention will be more fully understood by reference to the following example which presents comparative data obtained from runs illustrating its more salient features. All parts are given in terms of weight except as otherwise specified.

A commercial BASF-R fused iron ammonia synthesis catalyst was employed in conducting the tests and demonstrations described in the following example wherein PNA-containing hydrocracker streams were treated to remove PNA's. The BASF-R fused iron catalyst, as received, had been prereduced by the manufacturer in a hydrogen-containing ammonia synthesis recycle stream and surface stabilized for shipment and handling. The larger, as received particles were ground and screened to smaller size prior to use. The chemical and physical properties of the catalyst are given in Table I, as follows:

TABLE I

| Commercial and Physical Characteristics of BASF-R Fused Iron Catalyst | |
|---|---|
| | BASF-R |
| I. Chemical Composition (as received) Wt. % | |
| FeO | <1 |
| $Fe_2O_3$ | <1 |
| Free Fe | 90–95 |
| Total Fe Oxides | <2 |
| $Al_2O_3$ | 2–3 |
| $K_2O$ | 0.5–1 |
| CaO | 0.5–1.5 |
| $SiO_2$ | <0.5 |
| P | Trace |
| S as $SO_3$ | Trace |
| Chloride | <10 ppm |
| II. Physical Characteristics | |
| Bulk Density | |
| 165 lb/cu ft (oxidized form) | |
| 120 lb/cu ft (reduced form) | |

In conducting these runs, a stainless steel tubular reactor was employed in the upflow mode. A fixed bed of the fused iron catalyst, ground and screened to an appropriate mesh size, was centered within the reactor and heated by a conventional fluidized sandbath. The PNA-containing hydrocracker recycle feed and hydrogen treat gas were mixed in line and cocurrently introduced into the bottom of the reactor through a ⅛" stainless steel (SS) preheat line. In introducing the PNA-containing hydrocarbon feed, a small dual piston, positive displacement pump was employed. The temperature of the reaction was measured by a thermocouple located within the catalyst bed, and controlled by the use of an automatic temperature controller in operative association with the heat source. The product was passed out of the reactor through a back pressure regulator, employed to maintain the desired pressure, and collected in a vented, cooled flask located near the bottom of the reactor.

EXAMPLE

This example illustrates the removal of PNA's from a hydrocracker recycle stream via treatment over an activated fused iron catalyst. For this experiment, a 12.0 mL/25.5 g charge of BASF-R fused iron catalyst (14–35 mesh size) was loaded into the ½ inch SS reactor.

This catalyst charge was then reduced under the following conditions:

TABLE II

| Pretreatment Conditions for BASF Fused Iron Catalyst (Using Sandbath Heater) | | |
|---|---|---|
| Temperature Range | Treat Gas at 200 mL/min | Time at Conditions |
| 25–400° C. (77–752° F.) | $H_2$ Only | about 1.0 hour |
| 400–450° C. (752–842° F.) | $H_2$ Only | about 0.5 hour |
| 450–325° C. (842–617° F.) | $H_2$ Only | about 1.0 hour |

The dark gold, cloudy hydrocracker recycle stream, (which contained wax particles at room temperature) of boiling range 204°–482° C. (400°–900° F.) was then heated to homogeneity in glass, nitrogen-purged feed buret and fed to the catalyst bed of the reactor. The reaction conditions employed in this treatment over the fused iron catalyst and further information on the feedstock and products, three in all, are shown in Table III below.

TABLE III

PNA/Coronene Removal From Hydrocracker Recycle Stream Via Treatment Over Fused Iron Catalyst Feedstock: PNA-Containing H/C Recycle Stream 204–482° C. (400–900° F.)
LHSV: 1.0
TGR: 4000 SCF/B $H_2$

| | Temperature °C. (°F.) | PSIG | PPM Coronene | Color |
|---|---|---|---|---|
| Feed | — | — | 112 | Dark Gold |
| #1 | 325 (617) | 100 | 87 | Straw |
| #2 | 325 (617) | 250 | 53 | Colorless |
| #3 | 340 (644) | 250 | 25 | Colorless |

(1)The coronene concentration measurements were made based on the uv absorptivity at 302 nm vs. a standard 100 mg/mL solution of coronene.
(2)Following fused iron treatment, all products were oxidatively more stable than the feed since heavy PNA's and coronenes are believed to contribute to and/or cause sediment formation.

Figure 3:
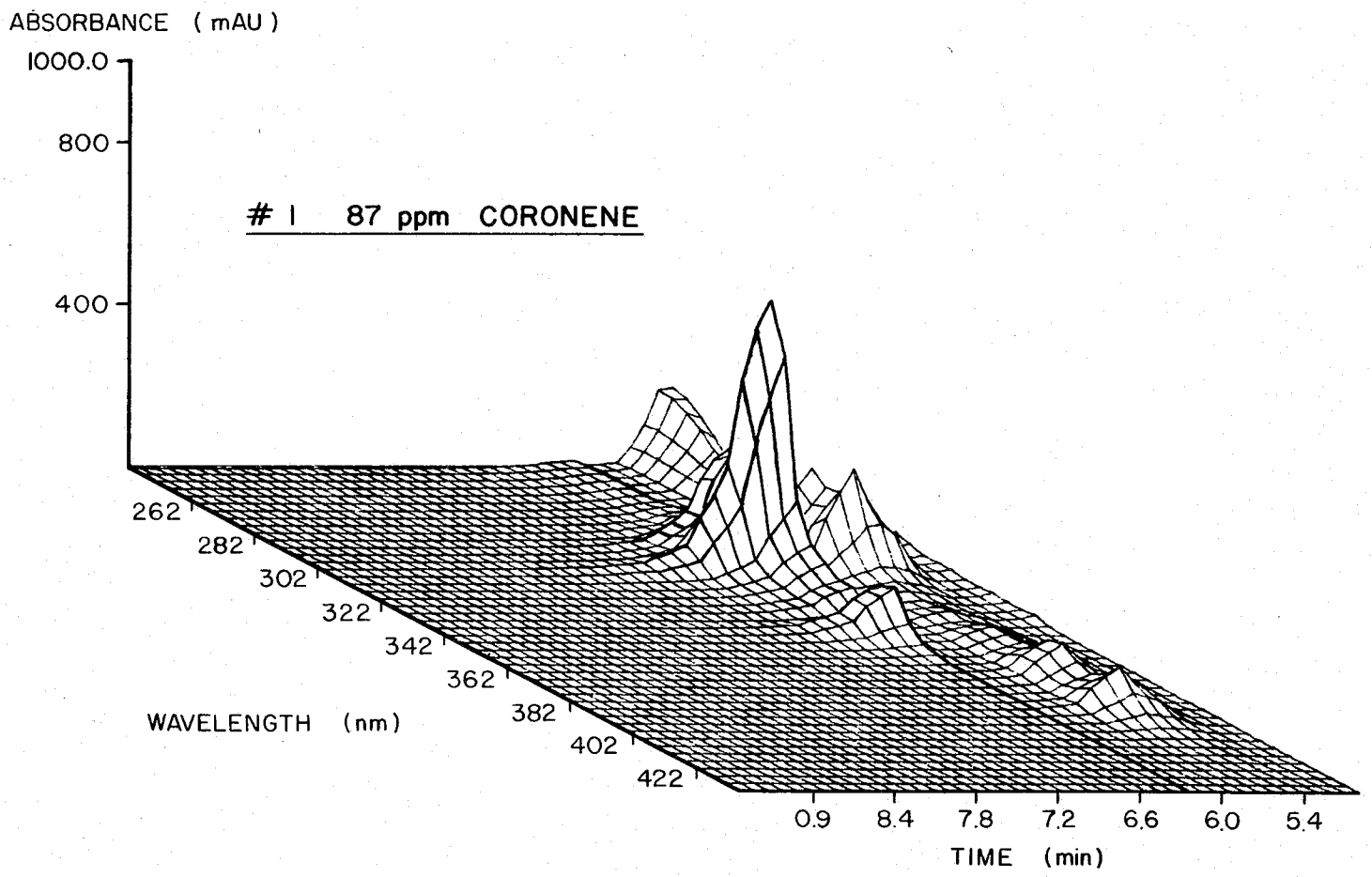
Figure 4:
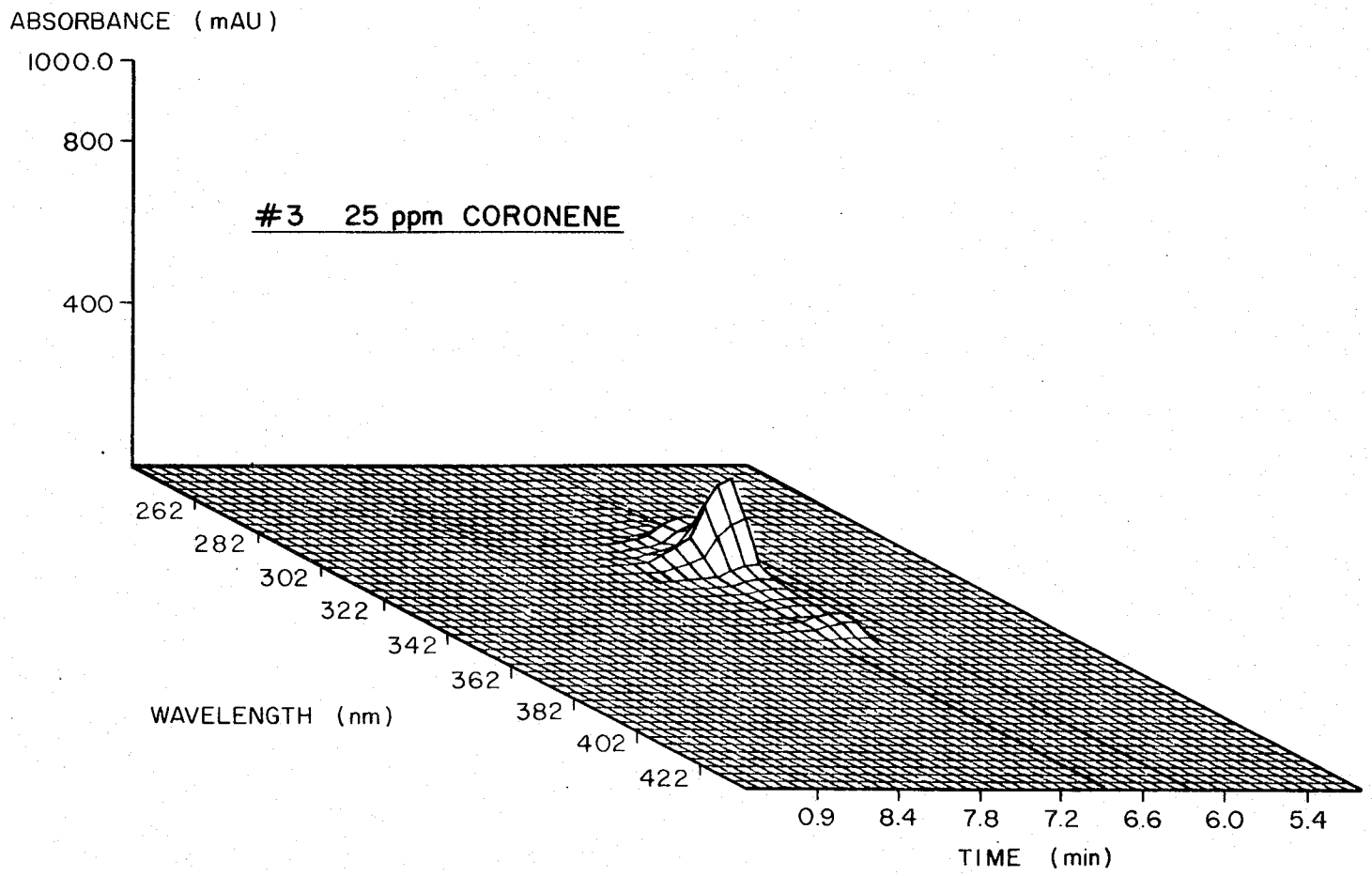

These results clearly indicate the capability of the iron catalyst at these conditions to remove heavy PNA's, even refractory coronenes, from a hydrocracker recycle stream by the practice of this invention. To further illustrate the reduction of PNA/coronene levels, graphic three-dimensional plots of high pressure liquid chromatograph-ultra violet (HPLC-UV) analyses were obtained. As the heavy aromatic materials eluted from the HPLC and were detected by the ultraviolet (UV) detector, the relative absorptivity was plotted versus elution time and UV wavelength (taken from "fast-scan" UV traces). This is shown graphically in FIGS. 2, 3, and 4.

Figure 2:
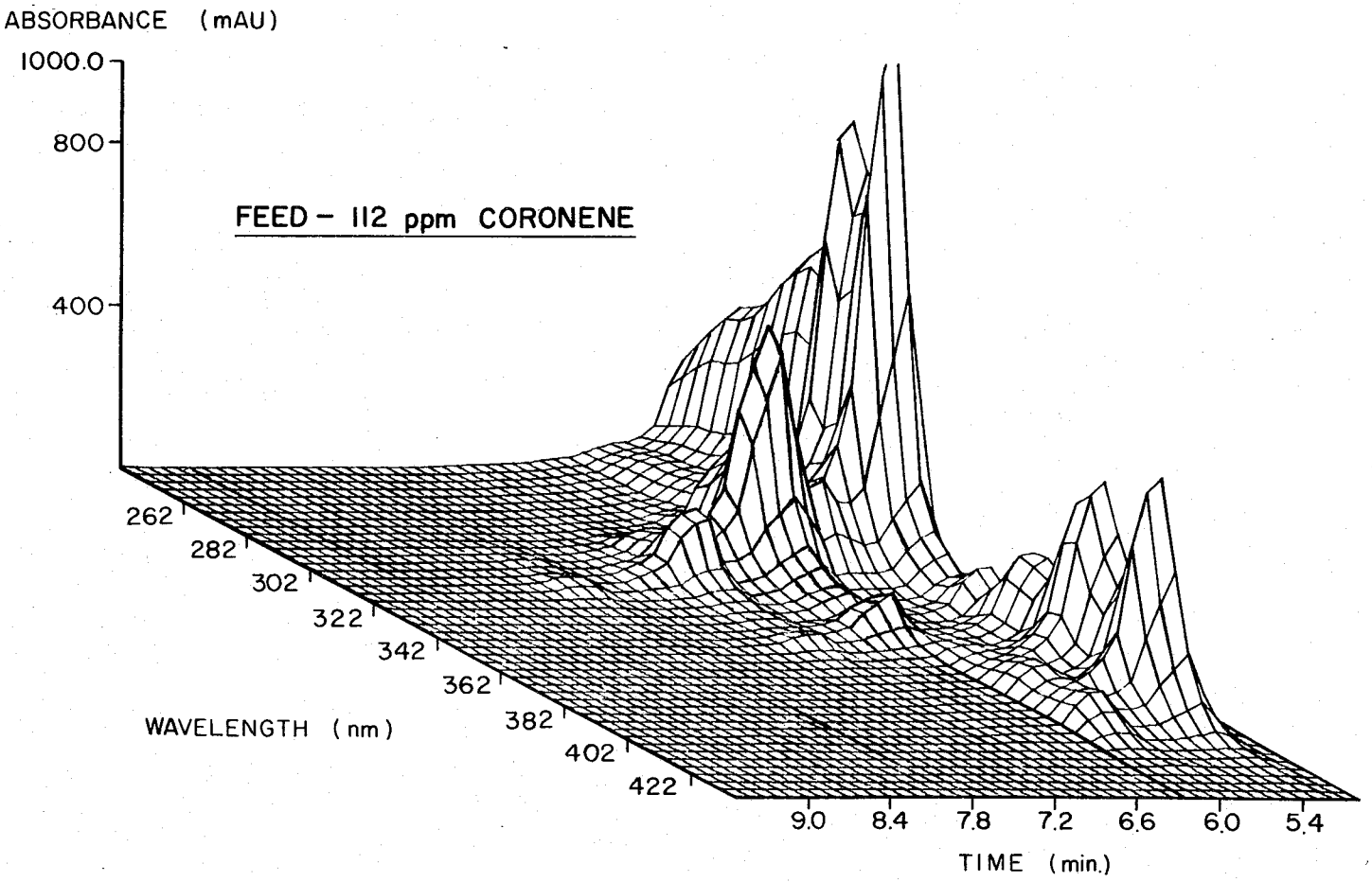
FIGS. 2-4 are graphic three-dimensional plots of analyses obtained of products resultant from experimental runs subsequently exemplified.

FIG. 2 shows the relative absorptivity (which is directly proportional to concentration) versus elution time and wavelength of the feed. Coronene elutes at about 6.4 minutes and displays an absorption maximum at 302 nm. The peaks at shorter elution times represent lower molecular weight PNA's (4- and 5-ring materials) while the peaks at longer elution times represent substituted coronenes and/or benzocoronenes. Comparing FIG. 2 to FIG. 3 (Sample #1) reveals a significant decrease in the total PNA concentration and a moderate decrease in the coronene peak at 6.4 min/302 nm. With regard to FIG. 4 (Sample #3), one readily observes that at the more severe reaction conditions essentially all of the lower molecular weight PNA's have been converted and removed while only a small amount of coronene remains. These results provide a clear and graphic demonstration of the capability of the process of this invention to decrease the concentration of PNA's and coronenes in hydrocracker recycle streams.

Having described the invention, what is claimed is:

1. A catalytic hydrocracking process which comprises:

(a) contacting a hydrocarbon feed having a propensity to form polynuclear aromatic hydrocarbon compounds in a hydrocracking zone with added hydrogen and a metal promoted crystalline zeolite hydrocracking catalyst at elevated temperature and pressure sufficient to produce substantial conversion of said feed to lower boiling products;

(b) condensing the hydrocarbon effluent from said hydrocracking zone and separating the same into a low boiling hydrocarbon product and unconverted hydrocarbon oil containing small quantities of polynuclear aromatic hydrocarbon compounds;

(c) contacting at least a portion of said uncoverted hydrocarbon oil containing polynuclear aromatic compounds with a catalyst which contains elemental iron and one or more of an alkali or alkaline-earth metal, or compound thereof, in the presence of hydrogen, at conditions inclusive of temperatures ranging from about 225° C. to about 430° C. sufficient to hydrogenate and hydrocrack the polynuclear aromatic hydrocarbon compounds; and (d) recycling unconverted hydrocarbon oil having a reduced concentration of polynuclear aromatic compounds resulting from step (c) to said hydrocracking zone.

2. The process of claim 1 wherein said hydrocarbon feed comprises a vacuum gas oil.

3. The process of claim 1 wherein said hydrocracking zone is maintained at a pressure from about 1000 psig to about 3000 psig.

4. The process of claim 1 wherein said hydrocracking zone is maintained at a temperature from about 232° C. to about 455° C.

5. The process of claim 1 wherein said metal promoted crystalline zeolite hydrocracking catalyst comprises synthetic faujasite.

6. The process of claim 1 wherein said metal promoted crystalline zeolite hydrocracking catalyst comprises nickel and tungsten.

7. The process of claim 1 wherein said metal promoted crystalline zeolite hydrocracking catalyst is comprised of nickel and molybdenum.

8. The process of claim 1 wherein the iron catalyst with which said unconverted hydrocarbon oil and hydrogen are contacted is characterized as a bulk iron catalyst which contains at least 50 percent elemental iron, based on the weight of the catalyst, and one or more alkali or alkaline-earth metals.

9. The process of claim 1 wherein the iron catalyst with which said unconverted hydrocarbon oil and hydrogen are contacted to hydrogeneate and hydrocrack the polynuclear aromatic hydrocarbon compounds contains from about 70 percent to about 98 percent elemental iron.

10. The process of claim 9 wherein the catalyst with which said unconverted hydrocarbon oil and hydrogen are contacted is a fused iron catalyst.

11. The process of claim 9 wherein the catalyst with which the feed and hydrogen are contacted contains one or more alkali or alkaline-earth metals in concentrations ranging from about 0.01 percent to about 10 percent.

12. The process of claim 11 wherein the catalyst additionally contains aluminum in concentration ranging from about 0.01 percent to about 20 percent.

13. The process of any one of claims 8 through 12 wherein the temperature of the reaction in which a portion of the unconverted hydrocarbon oil from step (a) is contacted with an elemental iron-containing catalyst as described in step (c) ranges from about 250° C. to about 350° C.

14. The process of any one of claims 1, or 8 through 12 wherein the hydrogen partial pressure in the reaction wherein a portion of the unconverted hydrocarbon oil from step (a) is contacted with an elemental iron-containing catalyst as described in step (c) ranges from about 0 psig to about 1000 psig.

15. The process of any one of claims 1, or 8 through 12 wherein the hydrogen partial pressure at reaction conditions in the reaction wherein a portion of the uncoverted hydrocarbon oil from step (a) is contacted with an elemental iron-containing catalyst as described in step (c) ranges from about 100 psig to about 600 psig.

16. The process of claim 1 wherein the iron catalyst with which the feed and hydrogen are contacted is characterized as an iron catalyst wherein the iron is dispersed upon an inorganic oxide support, the catalyst containing at least about 0.1 percent iron, based on the total weight of the catalyst, the supported metallic component containing at least 50 percent iron, exclusive of the support component, or components, of the catalyst, and the iron contains one or more alkali or alkaline-earth metals.

17. The process of claim 16 wherein the catalyst contains from about 0.1 to about 50 percent iron, based on the total weight of the catalyst.

18. The process of claim 16 wherein the supported metallic iron component of the catalyst contains from about 70 percent to about 98 percent iron, exclusive of the support component, or components.

19. The process of claim 16 wherein the catalyst contains the alkali or alkaline-earth metals in concentrations ranging from about 0.01 percent to about 10 percent.

20. The process of claim 19 wherein the catalyst additionally contains aluminum in concentration ranging from about 0.01 percent to about 20 percent.

21. The process of claim 16 wherein the alkali or alkaline-earth metals are contained in the catalyst in concentration ranging from about 0.01 percent to about 10 percent, and additionally aluminum in concentration ranging from about 0.01 percent to about 20 percent.

22. The process of any one of claims 9, or 16 through 21 wherein the temperature of the reaction conducted by contact of the feed with the iron catalyst ranges from about 250° C. to about 350° C.

23. The process of any one of claims 9, or 16 through 21 wherein the hydrogen partial pressure in the reaction conducted by contact of said unconverted hydrocarbon oil with the iron catalyst ranges from about 0 psig to about 1000 psig.

24. The process of any one of claims 9, or 16 through 21 wherein the hydrogen partial pressure in the reaction conducted by contact of said unconverted hydrocarbon oil with the iron caralyst ranges from about 100 psig to about 600 psig.

* * * * *